US008974185B2

(12) United States Patent
Franks

(10) Patent No.: US 8,974,185 B2
(45) Date of Patent: Mar. 10, 2015

(54) BALANCING OF ROTATABLE COMPONENTS

(75) Inventor: Robert Franks, Nottingham (GB)

(73) Assignee: Rolls-Royce PLC, London (GB)

( * ) Notice: Subject to any disclaimer, the term of this patent is extended or adjusted under 35 U.S.C. 154(b) by 405 days.

(21) Appl. No.: 13/472,942

(22) Filed: May 16, 2012

(65) Prior Publication Data

US 2012/0301298 A1 Nov. 29, 2012

(30) Foreign Application Priority Data

May 23, 2011 (GB) ..... 1108556.0

(51) Int. Cl.
*F01D 5/10* (2006.01)
*F01D 5/02* (2006.01)
*F01D 5/30* (2006.01)

(52) U.S. Cl.
CPC ..... *F01D 5/027* (2013.01); *F01D 5/3007* (2013.01)
USPC ..... 416/144

(58) Field of Classification Search
USPC ..... 416/144
See application file for complete search history.

(56) References Cited

U.S. PATENT DOCUMENTS

| | | | | | |
|---|---|---|---|---|---|
| 2,843,356 | A | * | 7/1958 | Hull, Jr. | 416/144 |
| 3,887,298 | A | * | 6/1975 | Hess et al. | 416/220 R |
| 4,477,226 | A | * | 10/1984 | Carreno | 416/144 |
| 4,480,957 | A | * | 11/1984 | Patel et al. | 416/220 R |
| 4,898,514 | A | * | 2/1990 | McCracken | 416/95 |
| 5,018,943 | A | * | 5/1991 | Corsmeier et al. | 416/144 |
| 5,425,621 | A | * | 6/1995 | Maar | 416/144 |
| 5,584,659 | A | * | 12/1996 | Schmidt | 416/221 |
| 2006/0266114 | A1 | * | 11/2006 | Pichel et al. | 73/460 |
| 2010/0296937 | A1 | * | 11/2010 | Bestwick | 416/219 R |

FOREIGN PATENT DOCUMENTS

| | | | |
|---|---|---|---|
| EP | 0 314 606 | A2 | 5/1989 |
| EP | 2 253 800 | A2 | 11/2010 |
| GB | 2 139 709 | A | 11/1984 |
| GB | 2 408 296 | A | 5/2005 |

OTHER PUBLICATIONS

British Search Report issued in British Application No. GB1108556.0 dated Sep. 5, 2011.

* cited by examiner

*Primary Examiner* — Liam McDowell
(74) *Attorney, Agent, or Firm* — Oliff PLC

(57) ABSTRACT

A balanced rotor component for a gas turbine engine having a aerofoil with a root and an rotor with an axial aerofoil root slot. The aerofoil root has a cavity which holds a balance weight. The cavity is open along at least one wall and the balance weight is spaced from the slot wall to minimise stress concentrations.

7 Claims, 5 Drawing Sheets

BALANCING OF ROTATABLE COMPONENTS

FIELD OF THE INVENTION

The present invention relates to the balancing of rotors in a turbine engine and particularly the balancing of compressor or turbine rotors and balance weights and methods therefore.

BACKGROUND OF THE INVENTION

Referring to FIG. 1, a turbofan gas turbine engine 10 comprises in flow series an inlet 32, a fan 2 and a core engine 4 comprising an intermediate pressure compressor 12, a high pressure compressor 14, a combustor 16, a high pressure turbine 18, an intermediate pressure turbine 20, a low pressure turbine 22 and an exhaust. The fan 2, compressors 12, 14, and turbines 18, 20, 22 are all arranged to rotate about a central common engine axis 1. Air is drawn into the engine 10, as shown by arrow B, through the annular inlet 32 and into the fan 2. The fan 2 compresses the air and a portion flows, in a downstream direction, into the core engine 4 where it is further compressed, mixed with fuel and burnt in the combustor 16.

Gas turbine and compressor rotors tend to operate at high rotational speeds, and because of this any out-of-balance in the main rotating assembly of a gas turbine is capable of producing vibration and stresses which increase as the square of the rotational speed. Very accurate balancing, both static and dynamic, is therefore necessary.

The three basis methods of correcting unbalance of a rotor are redistribution of weight, addition of weight and removal of weight. Redistribution of weight is possible for turbine and compressor rotors by interchanging blades which are of slightly different weights caused by manufacturing tolerance. However, this technique may not be sufficient in itself to correct all imbalances and involves time consuming extraction and refitting of the blades in a different order. Removal of weight is normally achieved by filing metal from balancing lands, but again this may not be sufficient to restore balance and is normally only employed when balancing individual components such as turbine or compressor shafts which are going to be incorporated into larger rotating assemblies.

The addition of weight is the most commonly used method, involving the use of small balance weights secured at appropriate points around the rotor. The present invention seeks to provide an improved method of balancing a rotor and an improved apparatus for balancing a rotor.

According to a first aspect of the invention there is provided a balanced rotor component for a gas turbine engine, the balanced component rotatable about an axis in use and having at least one slot having a profile holding a complementary profile of a root portion of a blade member, wherein the slot holds a balance weight which is in contact with the base of the slot at rest, the balance weight being further located within a cavity in the root portion.

The slot may be circumferential or axial. The blade member may be a compressor blade or a turbine blade. The turbine blade may be located in a turbine of a gas turbine engine. The compressor blade may be located in a compressor of a gas turbine engine. The rotor component may be a disc, ring or drum. The slot may be of the dovetail form, or in a fir-tree form or any other appropriate slot shape as known in the art.

Preferably the slot is axial and the cavity has at least an axially forward or an axially rearward wall defining the axially forward or axially rearward extent of the cavity. Preferably the cavity has both an axially forward and an axially rearward wall.

The axially forward and axially rearward walls may diverge and converge with respect to a centre line defined between the two walls to provide a cavity or recess of reflected trapezoid form.

Preferably the lateral sides of the cavity are open.

The radially inner surface of the balance weight may have a form which matches the base of the slot.

The slot may be axial and the balance weight has fore, aft sides and lateral sides, wherein at least one of the lateral sides has two portions joined at an obtuse angle. Preferably at least one of the lateral portions is spaced from a side wall of the slot.

The slot may be axial and the balance weight has fore, aft sides and lateral sides, wherein at least one of the lateral sides is spaced from a side wall of the slot.

The balance weight may have a radially extending protrusion engaging a hole in the root portion.

The invention will now be described, by way of example only, with reference to the accompanying drawings in which.

Figure 1:
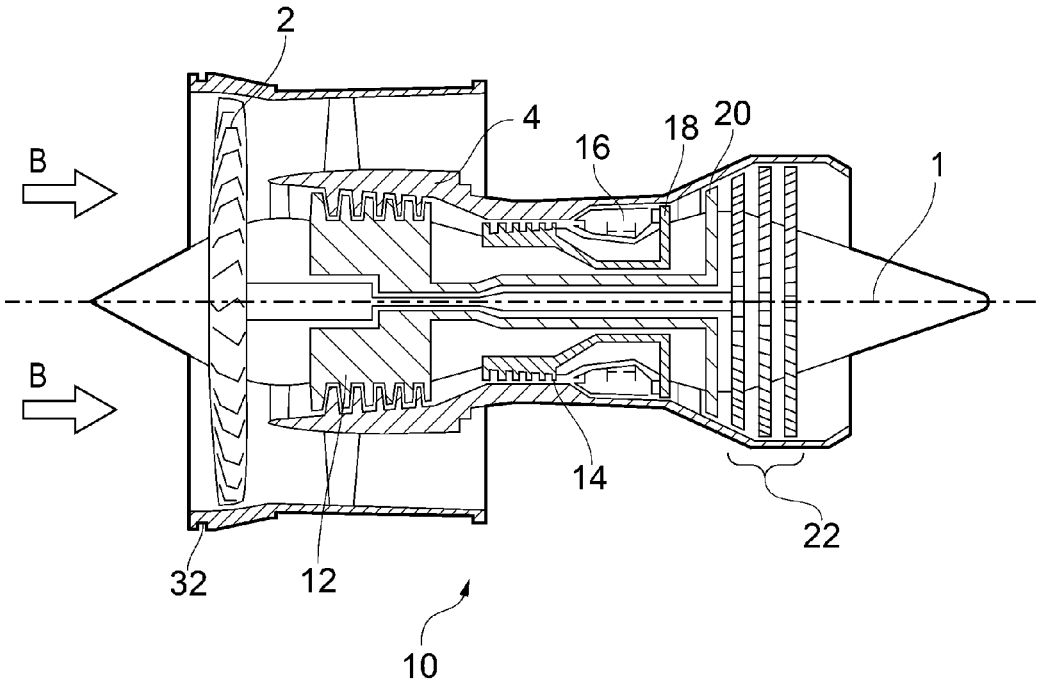
FIG. 1 RELATED ART
FIG. 1 depicts a gas turbine engine incorporating an apparatus for balancing the rotor in accordance with the invention.

Referring to FIG. 1, the fan stage 32, the compressors 12, 14, and the turbine 18, 20 and 22 can comprise a series of blades mounted in axial or circumferential slots. For the rest of the application the invention will be described with regard to axial slots but it will be appreciated that the invention may also be used in circumferential slots. It will be appreciated that the term axial and radial circumferential to the general direction in which the slot and the slots may be angled from the true axis or circumference of the component. Typically an axial slot will deviate less than 45° from the true axis and may also curve.

Figure 2:
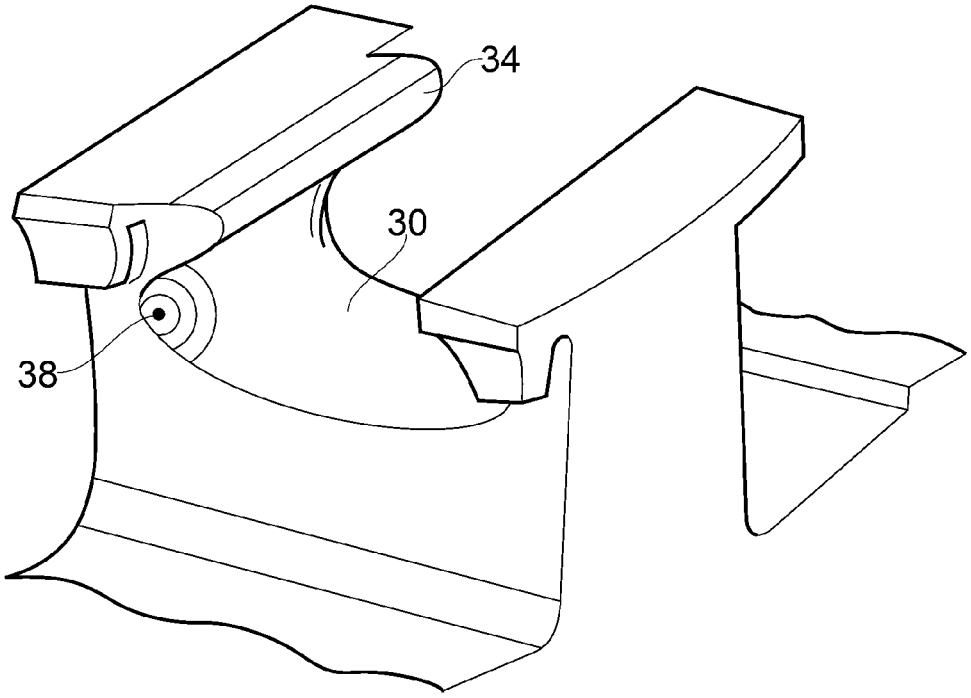
FIG. 2 depicts a portion of a compressor disc having an axial slot.

An axial slot in an intermediate pressure compressor is shown in FIG. 2. The slot is of the "dovetail" type with a portion 30 which receives a blade root and has a neck portion 34 which retains the blade and prevents it moving radially. It will be appreciated that the slot shown is only one in an array of slots which extends circumferentially around the disc and accordingly each land bisects adjacent slots. Similarly it will be appreciated that only one row of slots is shown and where the disc is part of an intermediate or high pressure compressor for example there may be a further row of slots either axially forward or axially rearward, or both axially forward and axially rearward of the slot depicted.

The disc is subject to significant stresses, one point of higher stress being indicated by the contour lines 38 though there are others regions subject to similarly high stress which are not shown. A region of higher stress can influence the allowed maximum working life of the disc which should not be permitted to fail in use.

Figure 3:
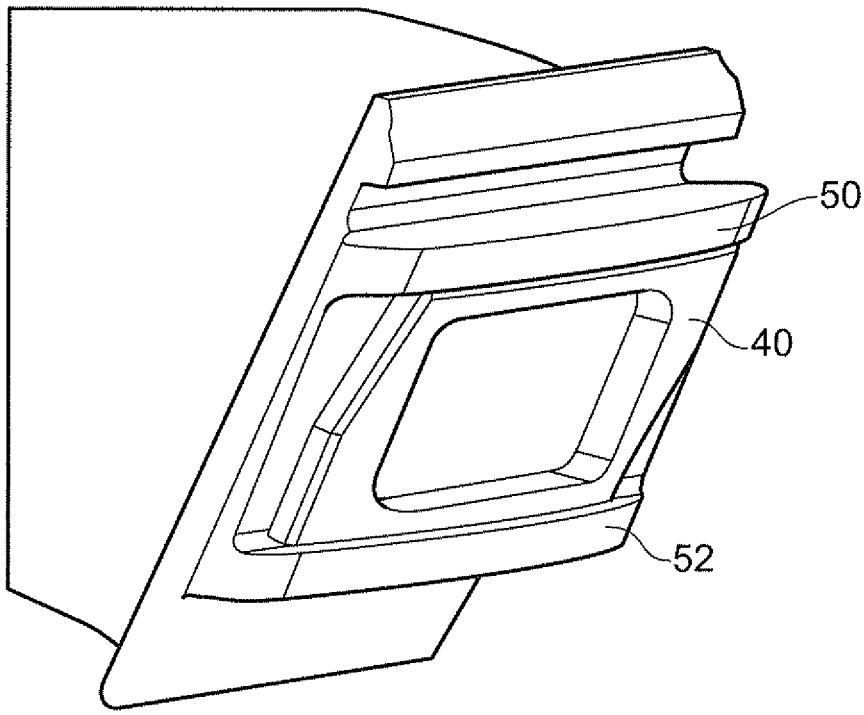
FIG. 3 depicts a balance weight located on a rotor blade.
Figure 4:
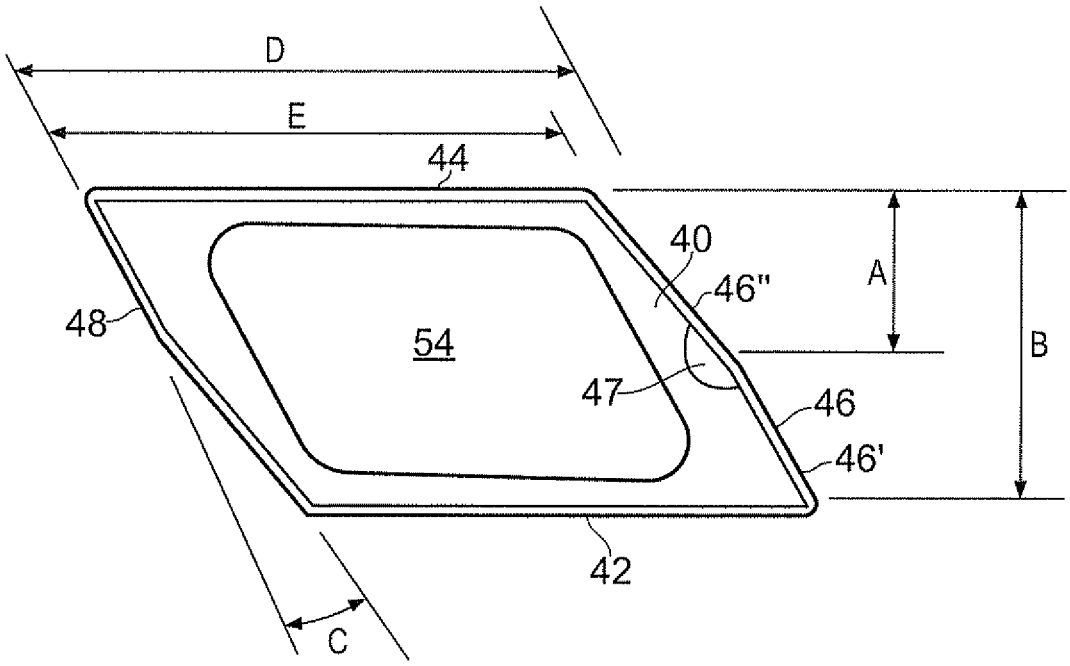
FIG. 4 is a further view of a balance weight.

A balance weight 40 which may be used to balance the disc is depicted in FIGS. 3 and 4. The weight is located in a cavity or recess in the root portion of the blade the cavity being open and defined between an axially forward wall 50 and an axially rearward wall 52 which prevent axial movement of the weight in use. The weight is permitted to slide circumferentially as induced by movement in use with circumferential stops being provided by the side walls of the slot.

The weight has a forward wall 42 and a rearward wall 44 and two lateral flanks 46, 48 which connect the forward wall and the rearward wall. The weight has a central cavity 54 the size of which may be varied to alter the mass of the weight whilst the outside "foot print" or form of the weight remains unchanged despite the mass of the weight selected to be used.

The lateral sides may be spaced from the wall of the slot or, more preferably, be formed as two or more portions joined at an obtuse angle. The lateral sides are arranged such that in the event of circumferential movement of the weight within the slot the lateral does not contact the walls of the slot at the point of its highest stress. Beneficially, this has been found to improve the working life of the disc by preventing additional stress load at a position which is already subject to high stress in use.

For the balance weight shown the extended length "D" of the forward and rearward walls, 42, 44 is around 27 mm with the lateral walls 46, 48 being spaced apart at a slightly shorter distance "B" of around 17 mm. It will be appreciated that these dimensions are exemplary and will depend on the size of the slot and the mass to be added by the balance weight, amongst other things. Also in the exemplary weight the length of portion 46" should preferably be no more than 80% of the total distance between the fore and aft walls 42,44. The obtuse angle 47 between the first portion 46' and the second portion 46" is selected such that the length "E" is no less than 20% of the extended length "D" of the forward wall 42. These proportions are typical for a number of sizes of balance weights but may be varied provided a reasonable contact area over lengths 44 and 42 is provided.

Figure 7:
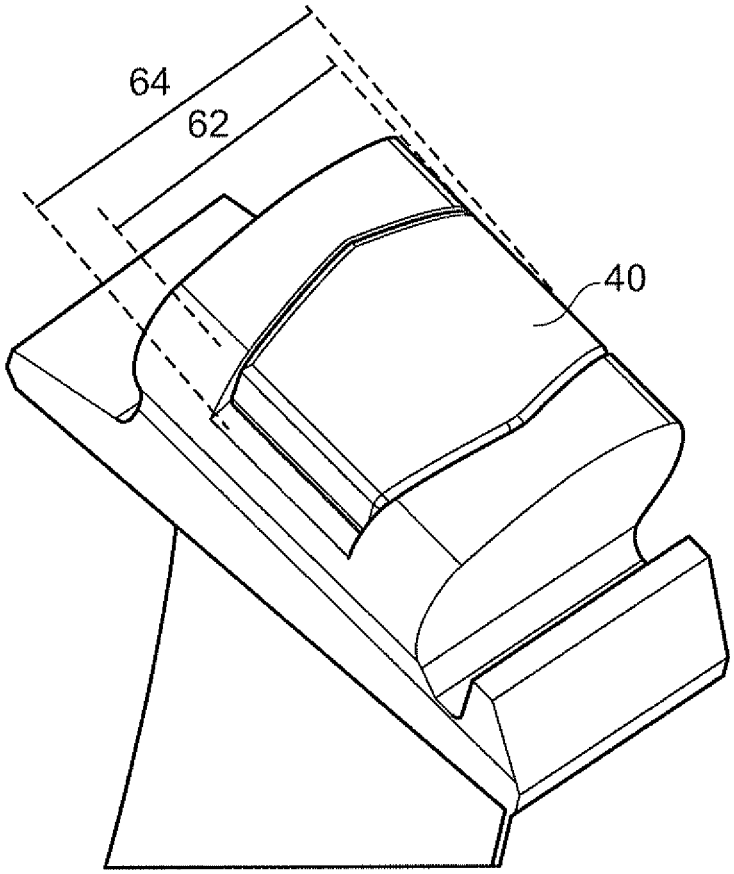
FIG. 7 depicts a balance weight located on a rotor blade.

The angle between the second portion of the lateral wall 46" and rearward wall 44 may be 90° to produce a generally rectangular balance weight or, as shown, it may be acute to provide a weight of a parallelogram form, or it may be obtuse to provide a reflected trapezoid as shown in FIG. 7.

Figure 5:
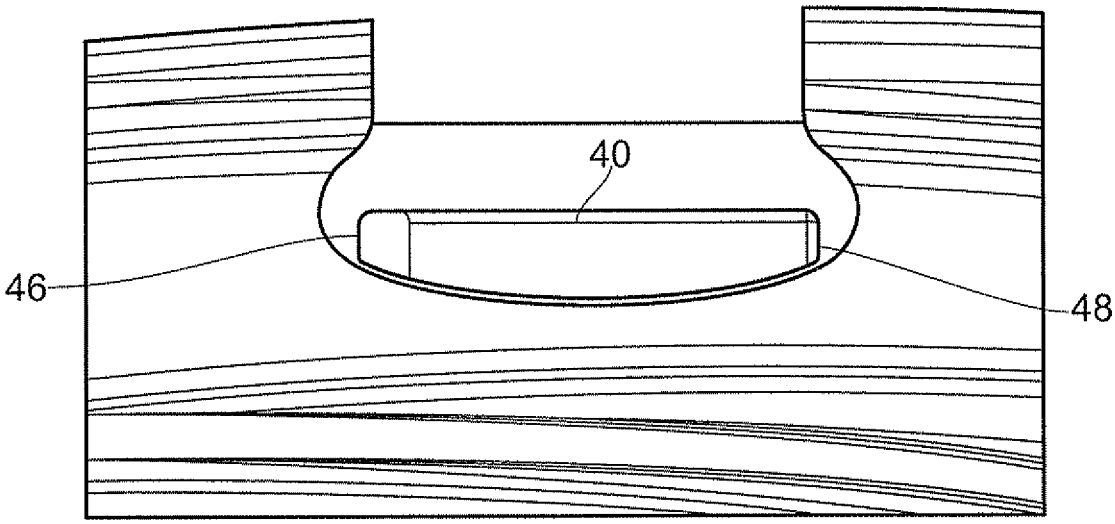
FIG. 5 is a view of a balance weight within an axial disc slot.
Figure 6:
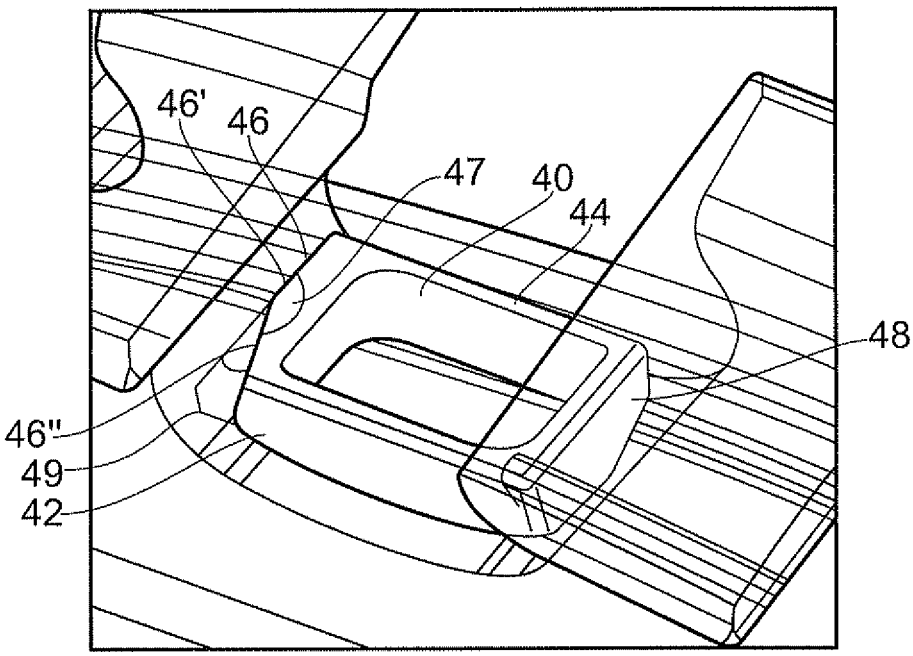
FIG. 6 is a further view of the balance weight within the axial disc slot.

As shown in FIGS. 5 and 6, the weight is sized such that it may be located in the slot and had a radially inner face which closely matches the shape of the base of the slot. The shape of the weight on its inner surface provides an even contact with the disc when the engine is not running and also assists in locating the weight in its correct circumferential location.

In use the loading of the weight is through the flanks of the blade root to the disc.

Figure 8:
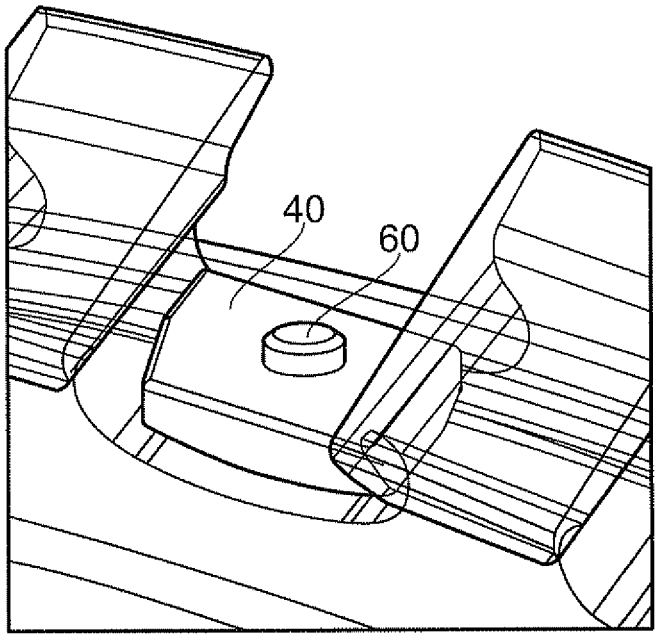
FIG. 8 depicts a balance weight within an axial disc slot.

In an alternative weight construction the recess in the blade root and the weight are of an inverted trapezoid construction as shown in FIG. 7. The weight shown has no cavity and is solid. A location feature 60 may be provided on the weight as shown in FIG. 8 to facilitate positioning on the blade root. The location feature may be a dowel or projection on the weight or root and an complimentary receptacle on the opposing component. One benefit of the reflected trapezoid is that the lateral movement of the weight is inhibited. To avoid contact of the weight with the slot wall the length of the weight 62 is chosen to be less than the length of the recess 64 in the blade root.

It will be appreciated that embodiments of the invention provide a simple and elegant assembly where the weight is enclosed to reduce the risk of the weight being unintentionally released in use. The weight is simple to replace and the standard footprint enables cheap and simple replacement should a heavier or lighter weight be required.

The person of skill in the art would also realise that features described with respect to one embodiment should be considered appropriate for use in other embodiments where the modification is possible. The applicant has considered all possible combinations of the embodiments and each is individually disclosed in this application.

The invention claimed is:

1. A balanced rotor component for a gas turbine engine, the balanced component rotatable about an axis in use and having at least one axial slot having a profile holding a complementary profile of a root portion of a blade member, wherein the slot holds a balance weight which is in contact with a base of the slot at rest, the balance weight being further located within a cavity in the root portion; wherein lateral sides of the cavity are open; and wherein a side of the balance weight has two portions arranged in axial series joined at an obtuse angle, one of the portions contacting a side wall of the slot and the other portion being spaced from the side wall of the slot.

2. The balanced rotor component according to claim 1, wherein the cavity has at least an axially forward or an axially rearward wall defining the axially forward or axially rearward extent of the cavity.

3. The balanced rotor component according to claim 2, wherein the cavity has both an axially forward and an axially rearward wall.

4. The balanced rotor component according to claim 3, wherein the axially forward and axially rearward walls diverge and converge with respect to a center line defined between the two walls.

5. The balanced rotor according to claim 1, wherein the radially inner surface of the balance weight has a form matching the base of the slot.

6. The balanced rotor according to claim 1, wherein the balance weight has a further side opposing the side of the balance weight, wherein the further side is spaced from one of the lateral side walls of the slot.

7. The balanced rotor according to claim 1, wherein the balance weight has a radially extending protrusion engaging a hole in the root portion.

* * * * *